343-700 MS AU 254 EX
9/6/83 OR 4,403,221

United States Patent [19]
Lamberg et al.

[11] 4,403,221
[45] Sep. 6, 1983

[54] MILLIMETER WAVE MICROSTRIP ANTENNA

[75] Inventors: John R. Lamberg, Minnetonka, Minn.; Joseph E. Ferris, Saline, Mich.

[73] Assignee: Honeywell Inc., Minneapolis, Minn.

[21] Appl. No.: 291,542

[22] Filed: Aug. 10, 1981

[51] Int. Cl.[3] ..... H01Q 1/38
[52] U.S. Cl. ..... 343/700 MS; 343/840
[58] Field of Search ..... 343/700 MS, 840, 829

[56] References Cited

U.S. PATENT DOCUMENTS 4,364,050 12/1982 Lopez ..... 343/700 MS

*Primary Examiner*—Eli Lieberman
*Attorney, Agent, or Firm*—George W. Field

[57] ABSTRACT

An orthogonally-polarized microstrip patch radiator feed structure comprising a cavity of circular cross section, a microstrip radiation emitter including a first ground plane at the bottom of the cavity, a first non-conductive substrate overlying the first ground plane, a circular conductive transmit patch on the first substrate, and a first input line on the first substrate extending radially to the transmit patch, and a microstrip radiation receiver, including a second non-conducting substrate overlying and spaced from said first substrate, a second ground plane on the inner surface of the second substrate in the form of a first array of spaced parallel conductive bars orthogonal to the radius of the first input line, a circular receive patch on the outer surface of said second substrate in the form of a second array of spaced parallel conductive bars aligned with the bars of the first array, and a second input line of the second substrate connected to the receive patch and extending radially in a direction orthogonal to the first input line, so that the radiation from the transmit patch is emitted through the spaces between the bars of the arrays.

9 Claims, 5 Drawing Figures

MILLIMETER WAVE MICROSTRIP ANTENNA

The Government has rights in this invention pursuant to Contract No. DAAK-10-80-Q-0061 awarded by the Department of the Army.

FIELD OF THE INVENTION

This invention relates to the field of microwave engineering, and specifically to orthogonally-polarized microstrip patch radiator feed structures for reflector antennas.

BACKGROUND OF THE INVENTION

There are occasions when it is desirable to transmit and receive at a single location microwave signals having the same angle of arrival. This can be done by using a reflector antenna with a single feed and providing a circulator for transmit/receive capacity, or by providing the reflector antenna with two orthogonally-polarized side-by-side feeds. The former expedient increases the cost and intricacy of the installation, and the latter introduces an angle of "squint" between the directions of transmission and reception.

One of the known ways of constructing a radiation emitter or receiver at millimeter wave-lengths is known as the microstrip patch radiator, in which a transmitting or receiving patch is formed on the top of a microstrip circuit and connected by an impedance transformer to a conductor formed on the strip, the lower surface of the strip providing the necessary ground plan.

SUMMARY OF THE INVENTION

The present invention embodies an improvied microstrip patch radiator feed system for a reflector antenna in which a receiver feed comprises a patch directly over-lying the patch of a transmitter feed located in a cavity, the ground plane and receiving patch of the receiver feed being slotted to enable emission of the transmitting patch radiation therethrough.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

An antenna according to the invention is shown to comprise an asymmetrical parabolic reflector 20 to which there is secured a bracket 21 which supports, at the focus of the reflector, a microstrip feed structure 22. Bracket 21 may also conveniently support transmission lines, mixer diodes, a Gunn diode, and related components for the generation and reception of millimeter wave signals according to well known principles.

Figure 2:
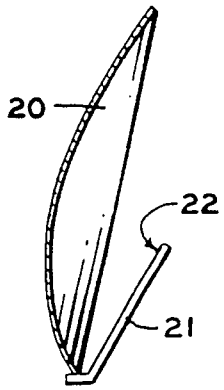
FIG. 2 is a sectional view along the line 2—2 of FIG. 1.
Figure 1:
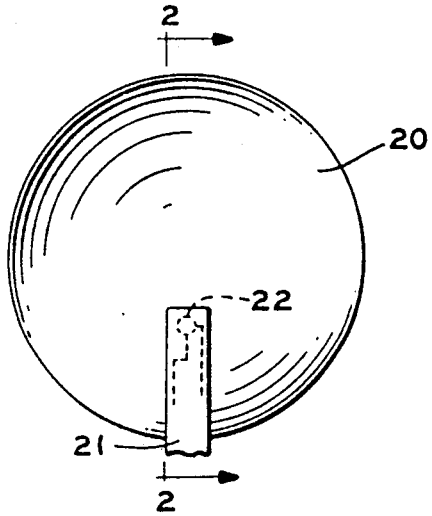
FIG. 1 is a front view of an antenna embodying the invention.
Figure 4:
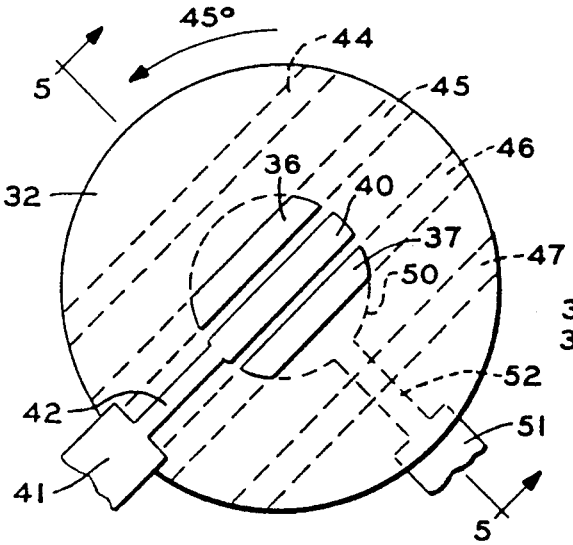
FIG. 4 is a somewhat schematic view of the invention to a larger scale.
Figure 5:
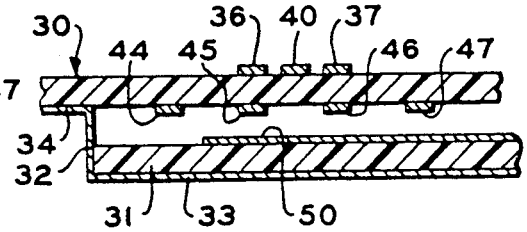
FIG. 5 is a sectional view generally along the line 5—5 of FIG. 4.

Structure 22 is shown in FIG. 4 and 5 to comprise a first microstrip circuit 30 spaced from and parallel to a second microstrip circuit 31, and includes a conductive cavity 32. Each microstrip comprises a thin dielectric substrate, both surfaces of which are coated with metal, which is removed in desired areas to define conductors, impedance transformers and antenna patch radiators.

The bottom conductive layer 33 of microstrip circuit 31 is unmodified and continuous: it is electrically connected with the bottom layer 34 of microstrip circuit 30 by the wall of conductive cavity 32. Within the area of cavity 32 the top conductive layer 35 of microstrip circuit 30 is largely etched away to leave a central portion in the form of an array of space parallel conductors 36, 37, and 40, a conductor 41, and an interconnecting impedance transformer 42.

The bottom conductive layer 43 of microstrip circuit 30 is etched away to leave a pattern in the form of an array of spaced parallel conductors 44, 45, 46, and 47: conductors 45 and 46 are parallel to and aligned with conductors 36 and 37.

The upper conductive layer of microstrip circuit 31 is largely etched away to leave a central disk 50, a conductor 51, and an interconnecting impedance transformer 52. The axes of conductors 41 and 51 are mutually orthogonal, the latter also being orthogonal to the spaced parallel conductors.

Figure 3:
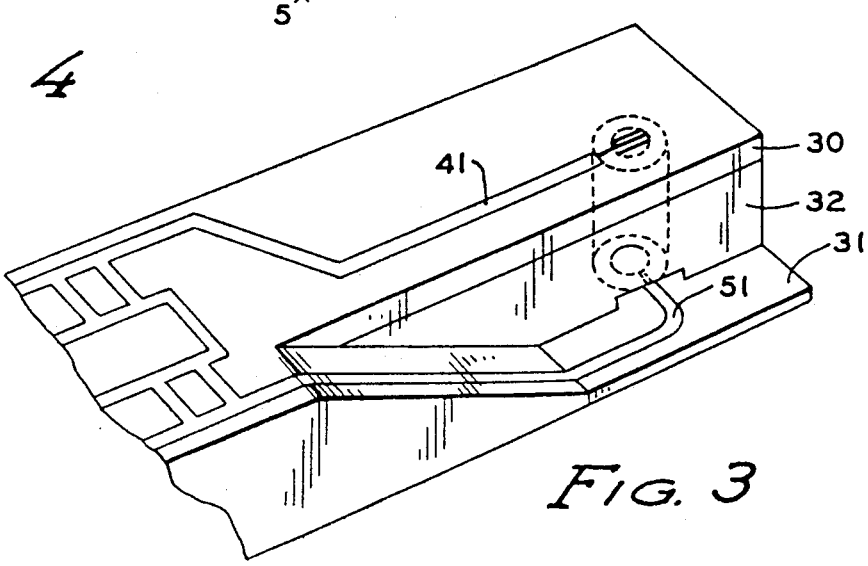
FIG. 3 shows one possible physical embodiment of the invention.

One possible physical embodiment of the invention is shown in FIG. 3, where microstrip circuits 30 and 31 and conductors 41 and 51 are particularly identified.

In one embodiment of the invention, for operation at a frequency of 35 GHz the following dimentions are satisfactory:

- Cavity 32 diameter—0.250 inches
- Cavity 32 depth—0.025 inches
- Substrate thickness—0.020 inches
- Substrate relative dielectric constant—2.2
- Bottom patch diameter—0.100 inches
- Width of conductors in arrays—0.020 inches
- Center-to-center spacing of conductors, ground plane—0.050 inches
- Center-to-center spacing of conductors, receiving patch—0.025 inches
- Input lines, width—0.060 inches
- Impedance transformer, length—0.063 inches
- Impedance transformer, width—0.014 inches.

Microstrip circuit 30 is intended for use as a receiving patch radiator, and is positioned for vertical polarization. Similarly microstrip circuit 31 is intended for use as a transmitting patch radiator, and is positioned for horizontal polarization. In use, microstrip circuit 31 is connected to a suitable millimeter wave signal generator, and microstrip circuit 30 is connected to a suitable millimeter wave receiver.

The operation of microstrip circuit 31 as a patch radiator with layer 33 as a ground plane is as is usual, except that its emissions must pass through the spaces between the conductors of microstrip circuit 30 to reach reflector 20. It has been found that the radiation passes through these spaces without difficulty. It has also been found that although the conductive layers of microstrip circuit 30 are arrays of spaced conducting portions rather than continuous, reception of incoming radiation by this second microstrip patch is not impaired.

It will be appreciated that the functions of microstrip circuits 30 and 31 in receiving and transmitting can be reversed, and that the invention is applicable for symmetrical as well as asymmetrical reflectors.

From the above it will be evident that the invention comprises an orthogonally-polarized dual microstrip patch radiator feed structure for simultaneous transmission and reception of millimeter waves in a single direction, without the need for a circulator and without introducing "squint" into the system.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principal of the invention, to the full extend indicated by the broad general meaning of the terms in which the appended claims are expressed.

We claim:

1. An orthogonally-polarized microstrip patch radiator feed structure comprising, in combination:

a cavity of circular cross section;

a microstrip radiation emitter including a first ground plane at the bottom of said cavity, a first non-conductive substrate overlying said first ground plane, a circular conductive transmit patch on said first substrate, and a first input line on said first substrate extending radially to said transmit patch;

and a microstrip radiation receiver, including a second non-conducting substrate overlying and spaced from said first substrate, a second ground plane on the inner surface of said second substrate in the form of a first array of spaced parallel conductive bars orthogonal to the radius of said first input line, a circular receive patch on the outer surface of said second substrate in the form of a second array of spaced parallel conductive bars aligned with the bars of said first array, and a second input line on said second substrate connected to said receive patch and extending radially in a direction orthogonal to said first input line, so that the radiation from said transmit patch is emitted through the spaces between the bars of said arrays.

2. A structure according to claim 1 in which the bars of said second array are more closely spaced than the bars of said first array.

3. A structure according to claim 1 in which said second ground plane is of larger diameter than said transmit patch.

4. A structure according to claim 1 in which said cavity has a conductive wall connected to said ground planes.

5. A microwave antenna comprising a parabolic reflector, an orthogonally polarized microstrip patch antenna feed structure, and means supporting said feed structure substantially at the focus of said reflector, said feed structure comprising, in combination:

a cavity of circular cross section opening toward said reflector;

a microstrip radiation emitter in said cavity, including a first ground plane at the bottom of said cavity, a first non-conducting substrate overlying said first ground plane, a circular transmit patch on said substrate, and a first input line on said first substrate extending radially to said transmit patch through an impedance transformer;

and a microstrip radiation receiver comprising a second non-conductive substrate overlying and spaced from said first substrate, a second ground plane on the inner surface of said second substrate in the form of a first pattern of space parallel conductors orthogonal to said input line, a circular receive patch on the outer surface of said second substrate in the form of a second pattern of spaced parallel conductors aligned with the conductors of said first pattern, and a second input line on said second substrate connected to said receive patch through an impedance transformer, in a direction orthogonal to said first input lines, so that radiation from said transmit patch is emitted to said reflector through the spaces between the conductors of said patterns.

6. An antenna according to claim 5 in which one of said patterns comprises horizontal conductors.

7. An antenna according to claim 5 in which the conductors of one of said patterns lie in a set of parallel vertical planes.

8. The method of operating a microwave transeiver which comprises the step of emitting energy from a first microstrip patch antenna through gaps in the ground plane and receiving patch of a second microstrip patch antenna.

9. The method of claim 8 in which said patches are arranged for energization of orthogonal polarization.

* * * * *